US008237642B2

(12) United States Patent
Miller

(10) Patent No.: US 8,237,642 B2
(45) Date of Patent: Aug. 7, 2012

(54) METHOD FOR IMPROVING DISPLAY LIFETIME

(75) Inventor: Michael E. Miller, Honeoye Falls, NY (US)

(73) Assignee: Global OLED Technology LLC, Hemdon, VA (US)

( * ) Notice: Subject to any disclaimer, the term of this patent is extended or adjusted under 35 U.S.C. 154(b) by 1058 days.

(21) Appl. No.: 12/172,440

(22) Filed: Jul. 14, 2008

(65) Prior Publication Data

US 2010/0007587 A1 Jan. 14, 2010

(51) Int. Cl.
*G09G 3/32* (2006.01)

(52) U.S. Cl. ..... 345/83; 345/102; 315/169.3; 382/274

(58) Field of Classification Search ..... 345/76–77, 345/82–83, 690–699, 211–214, 102; 315/169.3, 315/151; 382/270–274; 348/671–675
See application file for complete search history.

(56) References Cited

U.S. PATENT DOCUMENTS

| | | | | |
|---|---|---|---|---|
| 4,181,753 | A | 1/1980 | Fischer | |
| 4,769,292 | A | 9/1988 | Tang et al. | |
| 5,061,569 | A | 10/1991 | VanSlyke et al. | |
| 6,366,025 | B1 | 4/2002 | Yamada | |
| 6,861,155 | B2 | 3/2005 | Bawendi et al. | |
| 2002/0014837 | A1 | 2/2002 | Kim et al. | |
| 2003/0011559 | A1 * | 1/2003 | Adachi et al. | 345/102 |
| 2003/0034435 | A1 | 2/2003 | Etienne-Cummings et al. | |
| 2003/0043088 | A1 | 3/2003 | Booth, Jr. et al. | |
| 2004/0170319 | A1 * | 9/2004 | Maurer | 382/167 |
| 2004/0178974 | A1 * | 9/2004 | Miller et al. | 345/82 |
| 2006/0007204 | A1 | 1/2006 | Reddy et al. | |
| 2006/0007206 | A1 | 1/2006 | Reddy et al. | |
| 2006/0007248 | A1 | 1/2006 | Reddy et al. | |
| 2006/0007249 | A1 | 1/2006 | Reddy et al. | |
| 2006/0055639 | A1 | 3/2006 | Yamada | |
| 2007/0057263 | A1 | 3/2007 | Kahen | |
| 2007/0139437 | A1 | 6/2007 | Boroson et al. | |
| 2007/0223018 | A1 * | 9/2007 | Lammers et al. | 358/1.9 |
| 2007/0279372 | A1 * | 12/2007 | Brown et al. | 345/102 |

FOREIGN PATENT DOCUMENTS

| | | | |
|---|---|---|---|
| EP | 1 505 565 | A1 | 2/2005 |
| WO | WO 2008/038568 | A | 4/2008 |

* cited by examiner

*Primary Examiner* — Liliana Cerullo
(74) *Attorney, Agent, or Firm* — Morgan, Lewis & Bockius LLP

(57) ABSTRACT

A method for adjusting the intensity values of colored pixels wherein each pixel has a first subpixel, a second subpixel, and a third subpixel, wherein each of the subpixels emits light of a different color and the lifetime of the first subpixel is lower than the lifetimes of the other colored subpixels, comprising: for each pixel, receiving intensity values corresponding to the intensity of each color subpixel in each pixel; and lowering the intensity value of the first subpixel in each pixel and still providing an acceptable pixel color to an observer.

9 Claims, 2 Drawing Sheets

METHOD FOR IMPROVING DISPLAY LIFETIME

FIELD OF THE INVENTION

The present invention relates to light-emitting displays and a method for improving the lifetime of such displays.

BACKGROUND OF THE INVENTION

Many emissive display devices exist within the market today. Among the displays that are available are thin-film, coated, electro-luminescent displays, such as Organic Light-Emitting Diode (OLED) displays. These displays can be driven using active matrix backplanes, which employ an active circuit, or passive matrix backplanes, which provide common signals to rows and columns of light-emitting elements.

In typical, prior-art OLED displays, it is known that the luminance of the different color emitters, e.g. red, green, and blue OLEDs, increases as current density delivered to the OLED is increased. The transfer function from current density to luminance typically behaves according to a linear function. Therefore, to increase the luminance of the display, one must increase the current delivered to an OLED with a given area. To maintain a color-balanced display, the current must be adjusted differentially to the three OLEDs to maintain the desired ratio of red:green:blue luminance.

Unfortunately, increasing the current density used to drive an OLED, and therefore the luminance, not only increases the power required to drive the OLED but also reduces the lifetime of the OLED. Perhaps of greater importance is not the overall aging but the fact that the aging of the different colors is not the same. Therefore, the luminance of some colors will degrade faster than others. To maintain a well-balanced, full color display, it is important that the relative luminance of the colored materials be maintained throughout the lifetime of the display.

The overall lifetime of a display can decrease through changes in relative color efficiency as well as decreasing luminance output. If one OLED material that produces a particular color of light degrades more rapidly than other materials that produce other colors of light, for example through heavier use, the particular light output from the material will decrease relative to the other colors. This differential color output change will change the color balance of the display, such that images may have a serious color imbalance, which is much more noticeable than a decrease in overall luminance. While this decrease in luminance and light output of the particular color can be compensated for by increasing the brightness of the particular color, such a solution increases the rate of aging and the power usage and exacerbates the change in relative color efficiency in the display. Alternatively, one can reduce the luminance of the more robust colors, but this lowers the overall brightness of the display. To maximize the useful lifetime of the display, it is important to maximize the time that the relative luminance of the color elements can be maintained while minimizing the loss of absolute luminance.

Flat panel displays with unequal areas of light-emitting material have been discussed by Kim et al. in US Patent Application 2002/0014837. The relative size of the red, green, and blue light-emitting elements are adjusted based on the luminous efficiency of the color materials employed in an OLED display. In some display configurations, the available red OLED materials have significantly lower luminous efficiency than the existing green and blue OLED materials.

Because of the lower efficiency of existing red OLED materials, if one wishes to maintain sub-pixels of equal size, the power per square area that must be provided to the low luminous efficiency material must be increased to obtain the desired light output. Using this criterion, Kim proposes an OLED display with a larger red-light-emitting area than the green- and blue-light-emitting areas. Thus, the relative power per area can be somewhat equalized across the different colored materials. However, optimizing the display layout suggested by Kim et al., does not necessarily lead one to a design in which the lifetimes of the three materials are optimized.

U.S. Pat. No. 6,366,025 by Yamada discloses an OLED display with unequal light-emitting element areas, wherein the areas of the light-emitting elements are adjusted with the goal of improving the lifetime of the OLED display. Yamada considers the emission efficiency of the material, the chromaticity of each of the emissive materials, and the chromaticity of the target display when attempting to determine the aim light-emissive element areas. However, Yamada fails to discuss other important characteristics of OLED materials that will affect device lifetime, such as the differences in the inherent luminance stability over time of different materials. More importantly, typical manufacturing approaches limit the maximum differences in the areas of the different colored subpixels. As such, this approach alone cannot compensate for all of the differences in emission efficiency of the materials, or for other important factors, such as optical characteristics or differences in the inherent luminance stability of the different materials that are typically used to form the differently colored subpixels.

SUMMARY OF THE INVENTION

There is a need for improved lifetimes for electroluminescent displays.

This object is achieved by a method for adjusting the intensity values of colored pixels wherein each pixel has a first subpixel, a second subpixel, and a third subpixel, wherein each of the subpixels is a different color and the lifetime of the first subpixel is lower than the lifetimes of the other colored subpixels, comprising:

a. for each pixel, receiving intensity values corresponding to the intensity of each color subpixel in each pixel; and b. lowering the intensity value of the first subpixel in each pixel and still providing an acceptable pixel color to an observer.

It is an advantage of this invention that it can extend the lifetime of an electroluminescent display while providing acceptable color to an observer. Other advantages, including a reduction in display power consumption and improved image quality can also result.

DETAILED DESCRIPTION OF THE INVENTION

Figure 1:
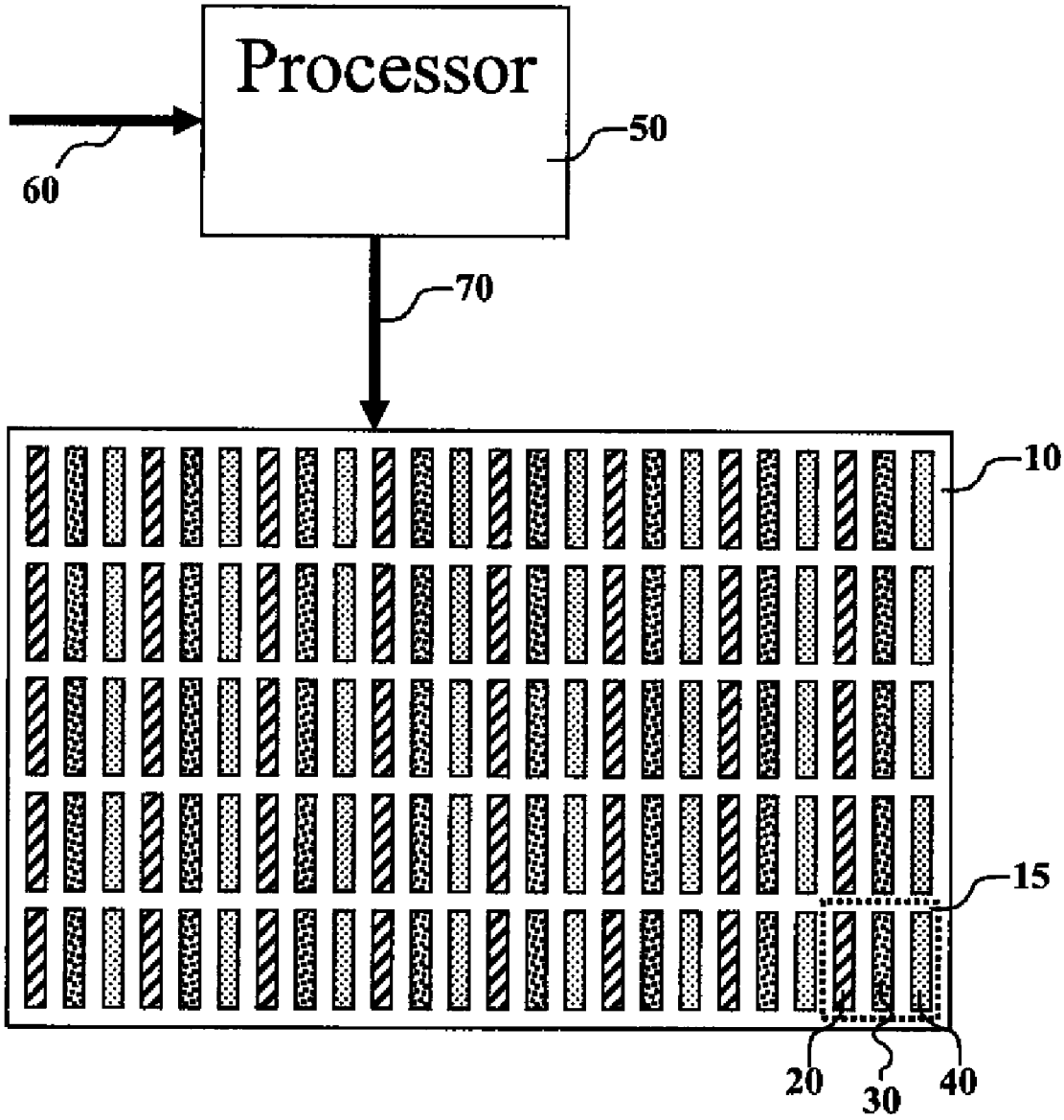
FIG. 1 shows one embodiment of a display that can be used in the practice of this invention.

Turning now to FIG. 1, there is shown one embodiment of a display that can be used in the practice of this invention. The display can include an electroluminescent (EL) display 10, such as an OLED display, and a controller 50 for providing the method of the present invention. Controller 50 can be any one or combination of digital or analog processors capable of receiving an input image signal 60, processing the input image signal, and providing a drive signal 70 to drive EL display 10. EL display 10 includes an array of colored pixels 15, wherein each pixel includes at least a first subpixel 20, a second subpixel 30, and a third subpixel 40, each of which emits light of a different color, e.g. blue, green, and red subpixels.

It is often seen that one of the colored subpixels, e.g. first subpixel 20, has a lower or shorter lifetime than the lifetimes of the other colored subpixels when all the subpixels are driven to equivalent luminance values, e.g. the luminance values required to produce a neutral or white display. Over time, this can change the color balance of the display. Thus, the useful lifetime of the entire display can be shortened by the subpixels of just one color. If the lifetime of these particular subpixels can be extended, the useful life of the entire display will be extended. This can be achieved through the method for adjusting the intensity values of colored pixels of this invention. For each pixel, controller 50 receives intensity values as part of input image signal 60. The intensity values correspond to the intensity of each color subpixel in each pixel 15. Controller 50 can lower the intensity value of first subpixel 20 in each pixel 15, on condition that an acceptable pixel color can be provided to an observer. This method will be described further.

Lower luminance saturated colors, including blue, red, and magenta, often appear more saturated than higher luminance saturated colors. Therefore, some manipulations, such as reducing intensity, can be performed on these colors with little or no perceived loss of image quality. In fact, it has been observed in the art that within many scenes, such a manipulation can improve the perceived quality of the display, particularly for the blue, red, and magenta colors. Lowering the intensity value of some colored subpixels when producing saturated, typically low luminance colors reduces the current required to form these colors in an electro-luminescent display, thus reducing overall power consumption for the display. Further, since certain colored subpixels can have lower lifetimes than others, reducing the power consumption of these subpixels will reduce the average current supplied to those subpixels, thereby extending their lifetimes and the useful life of the display. The method herein achieves this with an adjustment to the intensity values of the subpixels based upon the color saturation of the pixel. One or more of the intensity values of lower luminance saturated color pixels is reduced without changing the luminance of these same pixels when producing less saturated or neutral colors.

For the remainder of this discussion, it will be assumed that the blue subpixel is the first subpixel, that is, the subpixel with the lowest lifetime, and that the red and green subpixels are the second and third subpixels. In OLED displays, it is often the case that the blue-light-emitting subpixel has the shortest lifetime. However, it will be understood that one skilled in the art can apply this method to any subpixel of a light-emitting display that has a lower lifetime than others, regardless of color.

Figure 2:
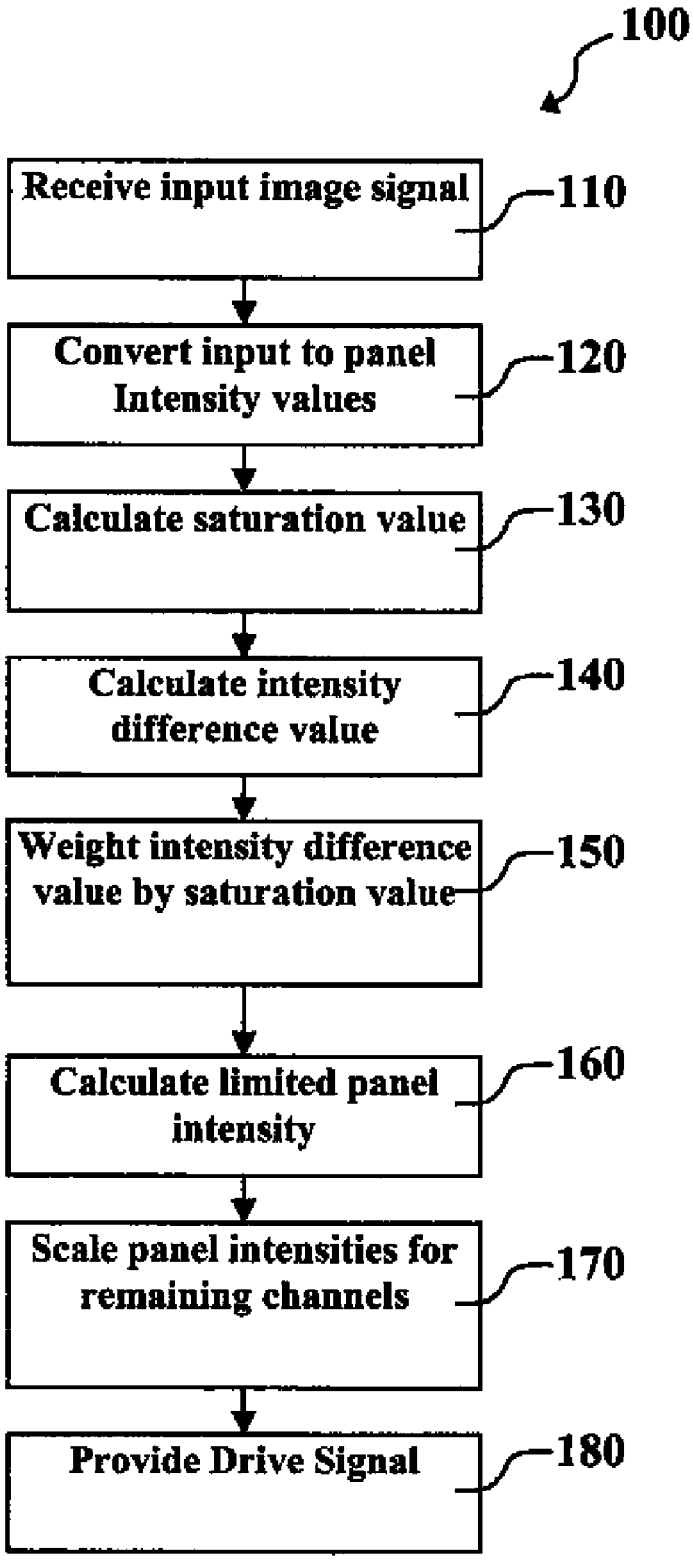
FIG. 2 shows one embodiment of the method of this invention.

Turning now to FIG. 2, and referring also to FIG. 1, there is shown one embodiment of the method of adjusting the intensity values of colored pixels of this invention. Controller 50 can receive intensity values corresponding to the intensity of each colored subpixel in each pixel. The intensity values form an input image signal 60 including red, green, and blue code values for an array of pixels of an input image (Step 110). Input image signal 60 can be encoded in any number of standard or other metrics. For example, input image signal 60 can be encoded according to the sRGB standard, providing the input image signal as an sRGB image signal. Table 1 provides a list of some example colors and sRGB code values for rendering these colors. This data will be used to demonstrate the processing steps of this particular embodiment when reducing the luminance of saturated blue colors with respect to less saturated blue colors.

TABLE 1

Input Code Values in sRGB Color Space

| Input Color | Red Code Value | Green Code Value | Blue Code Value |
|---|---|---|---|
| Red | 255 | 0 | 0 |
| Green | 0 | 255 | 0 |
| Blue | 0 | 0 | 255 |
| Pink | 255 | 125 | 125 |
| Light Green | 125 | 255 | 125 |
| Light Blue | 125 | 125 | 255 |
| White | 255 | 255 | 255 |
| Black | 0 | 0 | 0 |
| Dim Blue | 0 | 0 | 125 |
| Dim Light Blue | 64 | 64 | 125 |
| Gray | 125 | 125 | 125 |

Controller 50 can then convert the code values of input image signal 60 to panel intensity values corresponding to the intensity of each colored subpixel (Step 120). This is a standard manipulation that is well known in the art, and typically includes two steps. First, a tonescale manipulation is performed in which the intensity of the input code values are transformed from a nonlinear tonescale of the input color space (e.g., gamma of 2.2 for sRGB) to a space that is linear with the luminance output of each of subpixels 20, 30, and 40 in EL display 10. Second, a matrix multiplication is performed which rotates the colors of the input image from the input color space (e.g., sRGB) to the color primaries (that is, the subpixel colors) of the display panel. By converting input image signal 60 into panel intensity values, any manipulation of the panel intensity values that will be done as part of this method will produce a change in the output of the luminance of the subpixels that is proportional to the manipulation. For example, lowering a given panel intensity value by a factor of 2 decreases the luminance output of the respective subpixel by a factor of 2. Since luminance output of each of subpixels 20, 30, and 40 within an EL display is proportional to the current and current density for driving the respective subpixel, reducing a given panel intensity by a factor of 2 also reduces the current density used to drive the respective subpixel by the same factor. As shown in the prior art, EL light-emitting elements decay less rapidly when driven with lower current densities. Table 2 provides panel intensity values (normalized to 1) for the colors shown in Table 1. To calculate these values, it is assumed that display primaries match the sRGB specification (which implies that the matrix multiplication for each triplet of input red, green, and blue intensity values is performed with a 3×3 unity matrix) and the display drive value to luminance relationship can be accurately described by a gamma function with an exponent of 2.2.

TABLE 2

Panel Intensity Values

| Input Color | Red Panel Intensity | Green Panel Intensity | Blue Panel Intensity |
|---|---|---|---|
| Red | 1.0 | 0 | 0 |
| Green | 0 | 1.0 | 0 |
| Blue | 0 | 0 | 1.0 |
| Pink | 1.0 | 0.20 | 0.20 |

TABLE 2-continued

| Panel Intensity Values | | | |
|---|---|---|---|
| Input Color | Red Panel Intensity | Green Panel Intensity | Blue Panel Intensity |
| Light Green | 0.20 | 1.0 | 0.20 |
| Light Blue | 0.20 | 0.20 | 1.0 |
| White | 1.0 | 1.0 | 1.0 |
| Black | 0 | 0 | 0 |
| Dim Blue | 0 | 0 | 0.20 |
| Dim Light Blue | 0.05 | 0.05 | 0.20 |
| Gray | 0.20 | 0.20 | 0.20 |

A color-sensitive saturation value is then calculated as a function of the panel intensity values for each pixel in input image signal 60 (Step 130). This calculation for each pixel is independent of the intensities of other pixels in this method. In this embodiment, which assumes that only the average current density of the blue subpixel is to be reduced, this color-sensitive saturation value is a blue-sensitive saturation value. In one embodiment, the color saturation is calculated as a function of the intensity value corresponding to the first subpixel (the blue subpixel in this embodiment) and the minimum of the remaining (red and green) intensity values. The color saturation can be calculated by first determining if the blue panel intensity value (B) for a pixel is larger than the minimum of the red (R) and green (G) panel intensity values for the same pixel. If it is, the color-sensitive saturation value ($S_B$ for the blue-sensitive value) is assigned a value equal to the difference between the blue panel intensity value and the minimum of the red and green panel intensity values (Eq. 1a). Otherwise, it is assigned a value of 0 (Eq. 2). A color is considered to increase in saturation for increasing values of S for that color, e.g. saturation increases as $S_B$ approaches 1. However, for the purposes of this discussion, a color is considered to be saturated if S for that color, e.g. $S_B$, is non-zero. This can be expressed as:

if (B>min(R, G))

$$S_B=B-\min(R, G) \quad \text{(Eq. 1a)}$$

else $$S_B=0 \quad \text{(Eq. 2)}$$

end

The adjustment to be described below is based upon the color saturation of the pixel. Thus, by applying this color-sensitive saturation value in the adjustment, the blue panel intensity values will be reduced for all blue, cyan or magenta colors. That is, the blue panel intensity values will be reduced for all saturated colors between green and red.

The above saturation value (Eq. 1a) is not the only saturation value that can be used in this method. In another particularly useful embodiment, the color-sensitive saturation value is calculated as a function of the intensity value corresponding to the first subpixel and the maximum of the remaining intensity values. Thus, the minimum function of Eq. 1a is replaced with a maximum function (Eq. 1b).

$$S_B=B-\max(R, G) \quad \text{(Eq. 1b)}$$

By making this relatively subtle change, the algorithm will be adjusted such that the blue panel intensity values will be reduced for only blue colors (i.e., colors between cyan and magenta), without affecting pure cyan and magenta, or any colors between cyan and green or between magenta and red. Other useful embodiments include calculating the color-sensitive saturation value as a function of the intensity value corresponding to the first subpixel and either a simple mean (Eq. 1c) or a weighted mean (Eq. 1d) of the remaining intensity values.

$$S_B=B-(R+G)/2 \quad \text{(Eq. 1c)}$$

$$S_B=B-(R+3G)/4 \quad \text{(Eq. 1d)}$$

The use of a weighted mean such as in Eq. 1d, provides lower saturation values for cyan colors than for magenta colors. As noted earlier, the perceived saturation of magenta colors is increased as the luminance of magenta colors is reduced, which often improves the perceived image quality of the display. However, cyan colors are often high in luminance, and large reductions in the luminance of these colors can reduce the image quality of some scenes. By calculating the saturation value $S_B$ as a function of a mean weighted more heavily towards cyan, the algorithm will provide a smaller reduction in the luminance values of cyan colors than for blue or magenta colors, resulting in overall higher image quality.

Table 3 shows example values for $S_B$ for the panel intensity values in Table 2 using the min function (Eq. 1a) described above. As shown, the value of $S_B$ is greater than 0 anytime the blue panel intensity value in Table 2 is greater than the minimum of the red and green panel intensity value. It is also worth noting that the value of $S_B$ is larger when the blue panel intensity value is large and the difference between the blue panel intensity and the minimum of the red and green panel intensity value for each color is the greatest. Therefore, this value will be largest whenever the blue subpixel is to be driven to current densities much higher than those required for the red or green subpixel, decreasing the rate of differential luminance loss of the colored subpixels.

An intensity difference value ($D_B$) is then calculated for at least one color channel (Step 140), e.g. the blue color channel. This calculation can include the specification of a maximum limit ($L_B$) that the scaled panel intensity value cannot exceed and a threshold ($T_B$) above which the scaled panel intensity values will be reduced. Assuming the panel intensity values range from 0 to 1, a slope parameter ($m_B$) is first calculated as follows:

$$m_B=(L_B-T_B)/(1-T_B) \quad \text{(Eq. 3)}$$

A scaled panel intensity value B' can then be set equal to B for all values less than $T_B$. For values greater than $T_B$, B' can be calculated as:

$$B'=m_B*B \quad \text{(Eq. 4)}$$

B' values are also shown in Table 3, assuming a $L_B$ of 0.5 and a $T_B$ of 0. B' is larger than zero for all colors with blue content. The intensity difference value ($D_B$) is then calculated as:

$$D_B=(B-B') \quad \text{(Eq. 5)}$$

The values of $D_B$ are shown in Table 3. The intensity difference value is then weighted by the saturation value as shown by the term $S_B*D_B$ of Eq. 6 (Step 150). The term $S_B*D_B$ is the adjustment to the intensity value. The adjustment thus is a continuous function within a given range and depends (due to the term $S_B$) upon the intensity value of the second and third subpixels. The limited panel intensity (B") is computed by subtracting the weighted intensity difference from the original panel intensity (Step 160). This calculation can be expressed as:

$$B''=B-S_B*D_B \quad \text{(Eq. 6)}$$

The resulting values are shown in Table 3. The adjustment is based upon the color saturation of the pixel, such that the limited panel intensity value B" will equal B whenever $S_B$ is zero, e.g. when the input intensity values for a pixel indicate a neutral color (i.e., R=G=B). However, as $S_B$ increases, B"approaches ($B-D_B$) and the limited panel intensity value (B") of the blue subpixel is lowered. Notice that for intermediate values of $S_B$, such as shown for the light blue color, the resulting value of B" is between B' and B, allowing slow increases in limiting with increase in saturation.

TABLE 3

| Intermediate Calculated Values | | | | |
|---|---|---|---|---|
| Input Color | $S_B$ | B' | $D_B$ | B" |
| Red | 0 | 0 | 0 | 0 |
| Green | 0 | 0 | 0 | 0 |
| Blue | 1.0 | 0.50 | 0.50 | 0.50 |
| Pink | 0 | 0.10 | 0.10 | 0.20 |
| Light Green | 0 | 0.10 | 0.10 | 0.20 |
| Light Blue | 0.8 | 0.50 | 0.50 | 0.61 |
| White | 0 | 0.50 | 0.50 | 1.0 |
| Black | 0 | 0 | 0 | 0 |
| Dim Blue | 0.20 | 0.10 | 0.10 | 0.18 |
| Dim Light Blue | 0.15 | 0.10 | 0.10 | 0.19 |
| Gray | 0 | 0.10 | 0.10 | 0.20 |

The adjustment of the intensity of the blue subpixels is in the range of from no adjustment (e.g. for white) to one-half of the received intensity value (e.g. for blue). The maximum adjustment is determined by the value of $L_B$, which in this case is 0.5. It can be useful for some displays that the adjustment be in the range of from no adjustment to one-quarter of the received intensity value. The latter is achieved within the current embodiment by setting $L_B$ equal to 0.25.

The resulting value limited blue panel intensity value can be combined with the panel intensity value(s) from any remaining channels (e.g., R, G) to drive the display. However, colors containing a reduced blue panel intensity value together with some unreduced amount of red and green light-emission will undergo some degree of hue rotation, which is not desirable. Therefore, it is desirable to also process the red and green panel intensity values for pixels with a reduced blue panel intensity value. To avoid hue rotations and provide an acceptable pixel color to an observer, a reduction ratio is determined by dividing the limited blue panel intensity value (B") by the input blue panel intensity value (B). The red and green panel intensity values (i.e., the intensity values for the remaining channels) are then multiplied by the reduction ratio within the same pixel, scaling the panel intensities for the remaining channels (Step 170). This is shown as:

$$R'=R*(B''/B) \quad \text{(Eq. 7)}$$

$$G'=G*(B''/B) \quad \text{(Eq. 8)}$$

The resulting processed panel intensity values are shown in Table 4.

TABLE 4

| Processed Panel Intensity Values | | | |
|---|---|---|---|
| Input Color | R' | G' | B" |
| Red | 1.0 | 0 | 0 |
| Green | 0 | 1.0 | 0 |
| Blue | 0 | 0 | 0.50 |
| Pink | 1.0 | 0.20 | 0.20 |
| Light Green | 0.20 | 1.0 | 0.20 |
| Light Blue | 0.12 | 0.12 | 0.61 |
| White | 1.0 | 1.0 | 1.0 |
| Black | 0 | 0 | 0 |
| Dim Blue | 0 | 0 | 0.18 |

TABLE 4-continued

| Processed Panel Intensity Values | | | |
|---|---|---|---|
| Input Color | R' | G' | B" |
| Dim Light Blue | 0.05 | 0.05 | 0.19 |
| Gray | 0.20 | 0.20 | 0.20 |

Note that when the threshold value $T_B$ is zero, the ratio B"/B can be calculated by:

$$B''/B=1-(1-L_B)B+(1-L_B)\min(R,G) \quad \text{(Eq. 9)}$$

This ratio can then be multiplied by the R, G, and B values to provide the processed panel intensity values R', G', and B", respectively.

These resulting processed panel intensity values can then be provided to display 10 as a drive signal 70 (Step 180). It has been shown that this process has no effect on most colors in input images, including reds, greens, yellows, and whites. There are no practical hue shifts within the colors that are modified. Blue, cyan, and magenta colors are lower in luminance, but these colors typically have the appearance of higher saturation. Further, the images continue to appear natural and high in perceived image quality.

While the method as described provides high quality results, one skilled in the art will understand that many options exist for implementing or slightly modifying the process just described. For instance, during the calculation of B', a two-part linear equation is applied with an inflection point at the threshold $T_B$. However, other functions can be used in the place of this function. For example, the threshold $T_B$ can be set equal to zero, resulting in a linear function. Alternatively, each of the two linear portions can be provided with different slopes, which are each different than 1, allowing the output tonescale shape to be modified. In some embodiments, it can be useful to include a smaller slope for values less than the threshold $T_B$ and a larger slope above the threshold. Such a function can reduce the appearance of clipping for high input blue panel intensity values. Alternatively, other weightings or functions can be applied for the color sensitive saturation value ($S_B$). However, regardless of the implementation, the intensity of at least one color of the input image signal will be reduced as a function of both increasing input image signal value and color saturation to reduce the current density required to drive the subpixels having a shorter lifetime when displaying saturated colors, while allowing images at a high luminance white point to be presented with little or no modification.

Therefore, a typical OLED display, having a shorter lived blue subpixel than a red or green subpixel will produce a reduced luminance from the blue subpixel as a function of saturation of blue color, where saturation is defined using methods such as shown in Eq. 1a, 1b, 1c, or 1d. Each of these methods will generally provide an increase in saturation as the distance from the color to be displayed to the display white point increases in standard chromaticity spaces such as the CIE 1931 x,y chromaticity diagram. That is, using the method herein, a blue code value input to pixels in a display together with red and green code values near zero will produce significantly less blue subpixel luminance than produced by the same blue subpixel using the same blue code value but with red and green code values equal to or greater than the blue code values. The display will typically produce a color near the white point of the display in response to equal red, green, and blue code values but will produce a color having a large distance (i.e., greater than 0.1) from the display white point when the chromaticity coordinates of colors formed from a blue code value significantly different from zero together with red and green code value near zero are plotted within the 1931 CIE chromaticity diagram.

EL display 10 can be any EL display including a first subpixel 20, having a shorter lifetime than the lifetimes of the other colored subpixels 30 and 40 when all the subpixels are driven to equivalent luminance values. Such displays will typically include electro-luminescent layers in contact with a pair of electrodes, including a cathode and an anode. The electro-luminescent layers can include purely organic small molecule or polymeric materials, typically including organic hole-transporting, organic light-emitting, and organic electron-transporting layers as described in the prior art, including U.S. Pat. No. 4,769,292, issued Sep. 6, 1988 to Tang et al., and U.S. Pat. No. 5,061,569, issued Oct. 29, 1991 to VanSlyke et al. Such devices are called organic light-emitting diodes, or OLEDs, and displays formed from an array of such devices are called OLED displays. The electro-luminescent layers can alternately be formed from a combination of organic and inorganic materials, typically including organic hole-transporting and electron-transporting layers, with inorganic light-emitting layers, such as the light-emitting layers described in U.S. Pat. No. 6,861,155, issued Mar. 1, 2005 to Bawendi et al. Alternately, the electro-luminescent layers can be formed from fully inorganic materials such as the devices described in US Patent Application No. 2007/0057263, published Mar. 15, 2007. Such devices are called coatable inorganic light-emitting diodes, or CILEDs, and displays formed from an array of such devices are called CILED displays.

EL display 10 will contain three or more differently colored subpixels. When the chromaticity coordinates of these three or more differently colored subpixels are plotted in a chromaticity diagram, such as the CIE 1931 chromaticity diagram, the coordinates of three or more of the colored subpixels will form a polygon with the largest possible area, which represents the color gamut of the display. The method of the present invention will typically lower the intensity value of at least a first colored subpixel, having a lower lifetime than the other colored subpixels, when forming a primary color from that subpixel, while not necessarily lowering the intensity value of other colored subpixels when forming other primary colors. For example, as described in the previous example, the first 20, second 30, and third 40 subpixels form the gamut of the display. Only the intensity value of the blue colored subpixel is reduced when the pixel emits one of the three primary colors (blue) and not when it emits the other primary colors (red and green). In another example, in a display having red, green, blue and white subpixels, the chromaticity coordinates of the red, green, and blue subpixels will form the gamut of the display, and the intensity value of the blue colored subpixel can be reduced when forming the blue primary color without reducing the intensity value of the green or red colored subpixel when forming the green or red primary color, respectively.

US Patent Application Publication No. 2007/0139437 by Boroson et al. describes an OLED display for producing a full color image having three gamut-defining subpixels (e.g., red, green, and blue) and a fourth within-gamut subpixel (e.g. white) wherein the sum of the peak luminance produced by three gamut-defining subpixels is less than the display peak luminance. In this disclosure, the OLED display is described as including a drive means for regulating and reducing peak current for each of the gamut-defining subpixels such that the peak currents for the gamut-defining pixels is less than the sum of the nominal peak currents. As such, it can give reduced power requirements and lead to improved device lifetime. However, Boroson et al. require the presence of a within-gamut subpixel and apply the method equally to all the gamut-defining subpixels. Thus, it is not optimum for the case wherein one of the gamut-defining subpixels has a lower lifetime than the other subpixels.

In contrast, the present invention applies the reduction in intensity, and therefore current, preferentially to the subpixel with the lower lifetime. Further, the present invention bases the method upon the saturation of the color produced by that particular colored subpixel. As such, it will extend the lifetime of that particular colored subpixel, and reduce display color changes that can be caused by deterioration of one colored subpixel.

The invention has been described in detail with particular reference to certain preferred embodiments thereof, but it will be understood that variations and modifications can be effected within the spirit and scope of the invention.

PARTS LIST

| | |
|---|---|
| 10 | display |
| 15 | pixel |
| 20 | subpixel |
| 30 | subpixel |
| 40 | subpixel |
| 50 | controller |
| 60 | input image signal |
| 70 | drive signal |
| 100 | method |
| 110 | step |
| 120 | step |
| 130 | step |
| 140 | step |
| 150 | step |
| 160 | step |
| 170 | step |
| 180 | step |

The invention claimed is:

1. A method for adjusting the intensity values of colored pixels wherein each pixel has a first subpixel, a second subpixel, and a third subpixel, wherein each of the subpixels emits light of a different color and the lifetime of the first subpixel is lower than the lifetimes of the other colored subpixels, comprising:

a. for each pixel, receiving intensity values corresponding to the intensity of each color subpixel in each pixel; and b. adjusting by lowering the intensity value of the first subpixel in each pixel when producing saturated colors between green and red, with no-adjustment of the intensity of the first subpixel when producing neutral colors, wherein the subpixel colors are red, green, and blue, the first subpixel is the blue subpixel, the colored pixels are part of an electroluminescent display, and the adjustment is based upon the blue, cyan or magenta color saturation of the pixel, where the color saturation is calculated as a difference between the intensity of the first subpixel and a function of the second subpixel intensity and the third subpixel intensity.

2. The method according to claim 1 wherein the intensity of the first subpixel is adjusted to be in a range of no adjustment to one-half the received intensity value.

3. The method of claim 2 wherein the adjustment is continuous within the range and depends upon intensity value of the second and third subpixels.

4. The method of claim 1 wherein the intensity of the first subpixel is adjusted to be in a range of no adjustment to one-quarter the received intensity value.

5. The method of claim 4 wherein the adjustment is continuous within the range and depends upon intensity value of the second and third subpixels.

6. The method of claim 1 wherein the color saturation is calculated as a function of the intensity value corresponding to the first subpixel and the minimum of the remaining intensity values.

7. The method of claim 1 wherein the color saturation is calculated as a function of the intensity value corresponding to the first subpixel and a weighted mean of the remaining intensity values.

8. The method of claim 1 wherein the electroluminescent display is an Organic Light-Emitting Diode (OLED) display.

9. The method of claim 1 wherein the electroluminescent display is a Coatable Inorganic Light-Emitting Diode (CILED) display.

* * * * *